US008781374B2

(12) United States Patent
Teramura

(10) Patent No.: US 8,781,374 B2
(45) Date of Patent: Jul. 15, 2014

(54) DEVELOPER STORAGE BODY, IMAGE FORMING UNIT AND IMAGE FORMING APPARATUS

(75) Inventor: Osamu Teramura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 276 days.

(21) Appl. No.: 13/107,384

(22) Filed: May 13, 2011

(65) Prior Publication Data

US 2011/0280631 A1 Nov. 17, 2011

(30) Foreign Application Priority Data

May 17, 2010 (JP) ..... 2010-112874

(51) Int. Cl.
*G03G 15/08* (2006.01)

(52) U.S. Cl.
USPC ..... 399/262; 399/260

(58) Field of Classification Search
USPC ..... 222/DIG. 1; 399/106, 110, 119, 262, 399/258, 263, 260
See application file for complete search history.

(56) References Cited

U.S. PATENT DOCUMENTS 6,324,371 B1 * 11/2001 Okiyama et al. ..... 399/262

FOREIGN PATENT DOCUMENTS

JP 2001-042620 A 2/2001

* cited by examiner

*Primary Examiner* — Hoang Ngo
(74) *Attorney, Agent, or Firm* — Panitch Schwarze Belisario & Nadel LLP

(57) ABSTRACT

A developer storage body includes an outer case enclosing a space in which a developer is stored and having a first opening, and an inner case rotatably provided in the outer case and having a second opening. The inner case is rotatable with respect to the outer case between an opening position and a closing position to open and close the first opening. An operating portion is provided for operation to rotate the inner case between the opening and closing positions. The inner case includes a bottom wall having the second opening, and a plurality of beams provided so as to extend between edges of the bottom wall. The beam has an inclined upper surface. The inclined upper surface is inclined downward in a gravity direction toward a side end of the beam in a cross-section of the beam.

13 Claims, 12 Drawing Sheets

COMPARISON EXAMPLE

DEVELOPER STORAGE BODY, IMAGE FORMING UNIT AND IMAGE FORMING APPARATUS

BACKGROUND OF THE INVENTION

The present invention relates to a developer storage body, an image forming unit and an image forming apparatus.

Generally, an image forming apparatus using electrophotography, such as a printer, a facsimile machine or a copier, includes an image forming unit, an LED head, a transfer roller, a fixing unit and the like. The image forming unit includes a photosensitive drum, a charging roller, a developing unit, a cleaning roller and the like. The charging roller uniformly charges a surface of the photosensitive drum, and the LED head emits light to expose the surface of the photosensitive drum according to image data so as to form a latent image. The developing unit develops the latent image to form a toner image. The transfer roller transfers the toner image to a sheet as a printing medium. The fixing unit fixes the toner image to the sheet.

The image forming unit includes an image forming unit main body and a toner cartridge (i.e., a developer storage body) detachably mounted to the image forming unit main body. The toner cartridge includes an outer case in which a toner as a developer is stored, and an inner case rotatably provided in the outer case. The outer case has a toner supply opening through which the toner is supplied to the image forming unit main body. The inner case has a shutter part for opening and closing the toner supply opening (see, for example, Japanese Laid-Open Patent Publication No. 2001-42620).

Recently, there is a demand for a developer storage body capable of sufficiently supplying a developer to an image forming unit main body.

SUMMARY OF THE INVENTION

In an aspect of the present invention, it is intended to provide a developer storage body capable of sufficiently supplying a developer to an image forming unit main body, and to provide an image forming unit and an image forming apparatus using such a developer storage body.

According to an aspect of the present invention, there is provided a developer storage body including an outer case enclosing a space in which a developer is stored and having a first opening, and an inner case rotatably provided in the outer case and having a second opening. The inner case is rotatable with respect to the outer case between an opening position in which the inner case opens the first opening and a closing position in which the inner case closes the first opening. The developer storage body further includes an operating portion provided for operation to rotate the inner case with respect to the outer case between the opening position and the closing position. The inner case includes a bottom wall having the second opening, and a plurality of beams provided so as to extend between edges of the bottom wall. The beam has an inclined upper surface. The inclined upper surface is inclined downward in a gravity direction toward a side end of the beam in a cross-section of the beam.

With such a configuration, the developer is not likely to be accumulated on the inclined upper surface of each beam, and therefore a sufficient amount of developer can be supplied to the outside of the developer storage body.

According to still another aspect of the present invention, there is provided an image forming unit to which the above described developer storage body is mounted.

According to yet another aspect of the present invention, there is provided an image forming apparatus to which the above described image forming unit is mounted.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Figure 1:
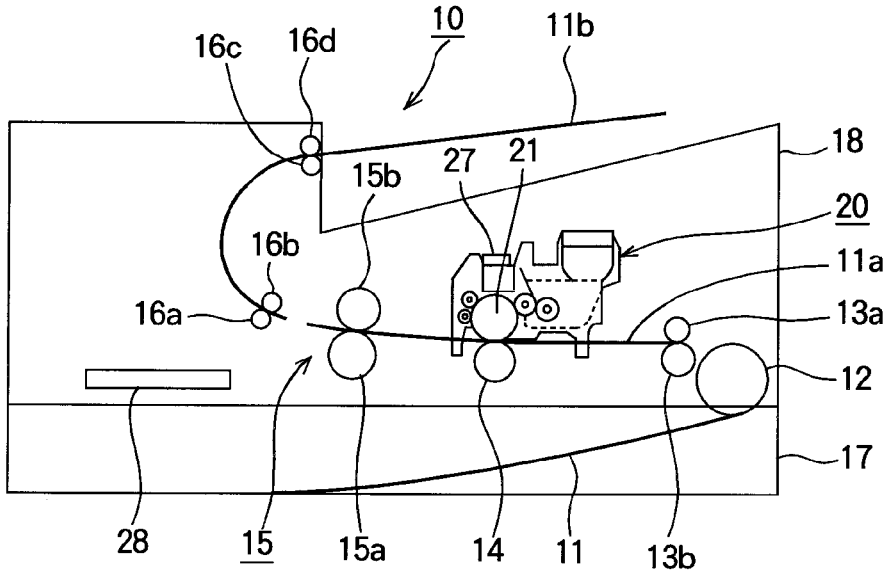
FIG. 1 is a schematic sectional view showing a configuration of a printer according to the first embodiment of the present invention.

FIG. 1 is a schematic sectional view showing a configuration of a printer 10 as an image forming apparatus according to the first embodiment of the present invention. The printer 10 has a housing 18 in which a sheet feeding path (i.e., a medium feeding path) of a substantially S-shape is provided. A sheet cassette 17 as a medium storage portion is mounted to a lower part of the housing 18. The sheet cassette 17 is configured to store sheets 11 (as printing media) therein. A hopping roller 12 as a medium feeding member is provided on an upper side of the sheet cassette 17. The hopping roller 12 is configured to feed the sheets 11 out of the sheet cassette 17 to the sheet feeding path. Registration rollers 13*a* and 13*b* as feeding-controlling members are provided adjacent to the hopping roller 12 along the sheet feeding path. The registration rollers 13*a* and 13*b* are driven to rotate to thereby control a timing to feed the sheet 11 to an image forming unit 20. The image forming unit 20 is detachably mounted in a main body (as an apparatus main body) of the printer 10. The image forming unit 20 includes a photosensitive drum 21 as an image bearing body.

An LED head 27 as an exposure device is provided above and facing the photosensitive drum 21 of the image forming unit 20. The LED head 27 is configured to emit light to expose a surface of the photosensitive drum 21 to form a latent image. A transfer roller 14 as a transfer member is provided below and facing the photosensitive drum 21 of the image forming unit 20. The transfer roller 14 is configured to transfer a toner image (i.e., a developer image) from the photosensitive drum 21 to the sheet 11. A fixing unit 15 as a fixing device is provided on a downstream side (i.e., the left in FIG. 1) of the image forming unit 20 along the sheet feeding path. The fixing unit 15 includes a pressing roller 15*a* and a heating roller 15*b* that fix the toner image to the sheet 11 by applying heat and pressure. Ejection rollers 16*a*, 16*b*, 16*c* and 16*d* are provided on a downstream side of the fixing unit 15 along the sheet feeding path. The ejection rollers 16*a*, 16*b*, 16*c* and 16*d* are driven to rotate to eject the sheet 11 (to which the toner image is fixed) to the outside of the housing 18. A control unit 28 is provided in the housing 18, which controls an entire operation of the printer 10. In FIG. 1, a reference numeral 11*a* indicates the sheet 11 passing through the image forming unit 20 along the feeding path, and a reference numeral 11*b* indicates the sheet 11 being ejected by the ejection rollers 16*a* through 16*d*.

Next, an operation of the printer 10 will be described.

When the hopping roller 12 is rotated, the individual sheet 11 is fed out of the sheet cassette 17. The sheet 11 is further fed by the registration rollers 13*a* and 13*b* to the image forming unit 20 and the transfer roller 14 at a timing adjusted in accordance with formation of the toner image on the photosensitive drum 21. The toner image is transferred from the photosensitive drum 21 to the sheet 11 by the transfer roller 14. Then, the sheet 11 is feed to the fixing unit 15, and is heated and pressed by the pressing roller 15*a* and the heating roller 15*b*, so that the toner image is fixed to the sheet 11. The sheet 11 (to which the toner image is fixed) is ejected by the ejection rollers 16*a* through 16*d* to the outside of the housing 18.

Next, a configuration of the image forming unit 20 will be described.

Figure 2:
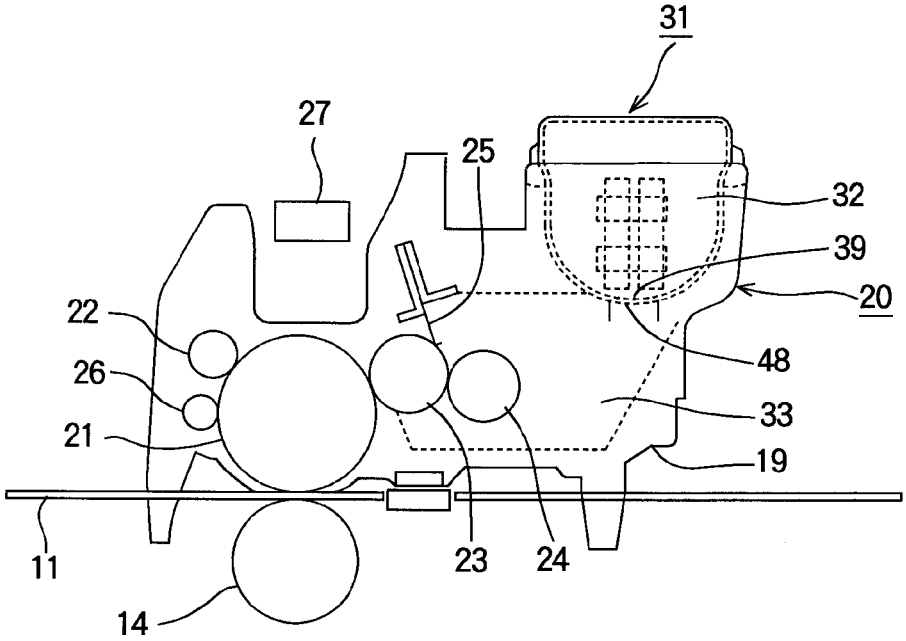
FIG. 2 is a schematic sectional view showing a configuration of an image forming unit according to the first embodiment of the present invention.
Figure 3:
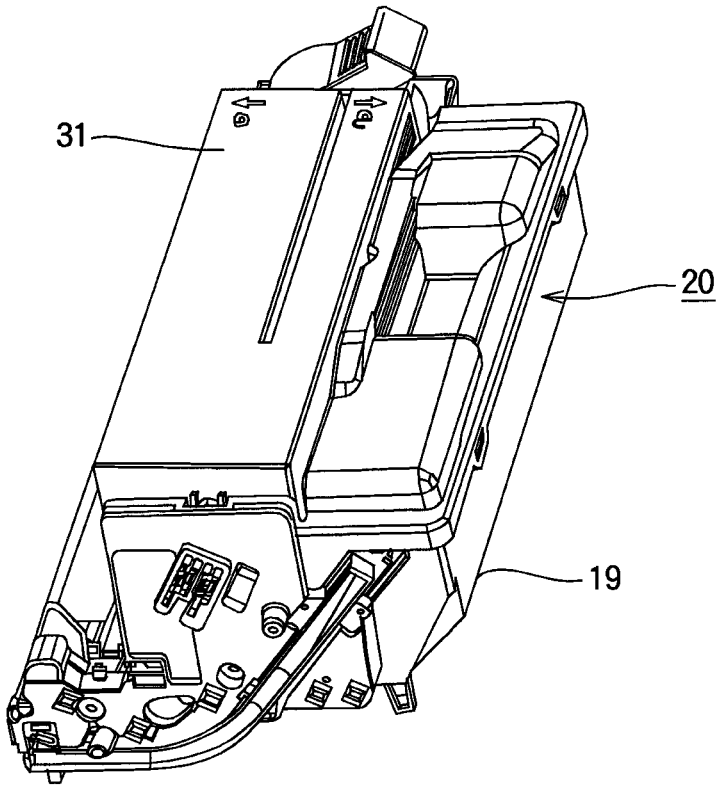
FIG. 3 is a perspective view showing an outer shape of the image forming unit according to the first embodiment of the present invention.

FIGS. 2 and 3 are a schematic sectional view and a perspective view showing the image forming unit 20 according to the first embodiment of the present invention.

As shown in FIG. 2, the image forming unit 20 includes an image forming unit main body 19 (i.e., a main body of the image forming unit 20) and a toner cartridge 31 as a developer storage body detachably mounted to the image forming unit main body 19. The image forming unit main body 19 includes the above described photosensitive drum 21, a charging roller 22 as a charging device that uniformly charges the surface of the photosensitive drum 21, a developing roller 23 as a developer bearing body that develops the latent image on the photosensitive drum 21 using a toner as a developer, and a toner supply roller 24 as a developer supply member that supplies the toner to the developing roller 23. The image forming unit main body 19 further includes a developing blade 25 as a developer layer regulating member that regulates the thickness of the toner layer on the developing roller 23, a cleaning roller 26 as a cleaning member for removing the residual toner that remains on the photosensitive drum 21 after the toner image is transferred to the sheet 11.

The toner cartridge 31 has a toner storage chamber 32 as a developer storage chamber for storing the toner. A toner supply opening 39 as a first opening is formed on the toner cartridge 31, through which the toner is supplied to the outside of the toner cartridge 31. The image forming unit main body 19 has a toner receiving opening 48 as a developer receiving opening provided so as to face the toner supply opening 39, and a toner chamber 33 as a developer chamber to which the toner is supplied from the toner cartridge 31 via the toner supply opening 39 and the toner receiving opening 48.

Next, an operation of the image forming unit 20 will be described.

When the toner is supplied from the toner cartridge 31 to the toner chamber 33 of the image forming unit main body 19, the toner is supplied to the developing roller 23 by the toner supply roller 24, and a toner layer is formed on the surface of the developing roller 23. The toner layer has a uniform thickness regulated by the developing blade 25.

The surface of the photosensitive drum 21 is uniformly charged by the charging roller 22, and is exposed with light emitted by the LED head 27, so that a latent image is formed on the surface of the photosensitive drum 21. The latent image is developed by the toner supplied by the developing roller 23, so that a toner image is formed on the surface of the photosensitive drum 21. The toner image is transferred from the photosensitive drum 21 to the sheet 11 by the transfer roller 14. The residual toner that remains after transferring of the toner image is scraped off by the cleaning roller 26, and is removed therefrom.

Next, a configuration of the toner cartridge 31 will be described.

Figure 4:
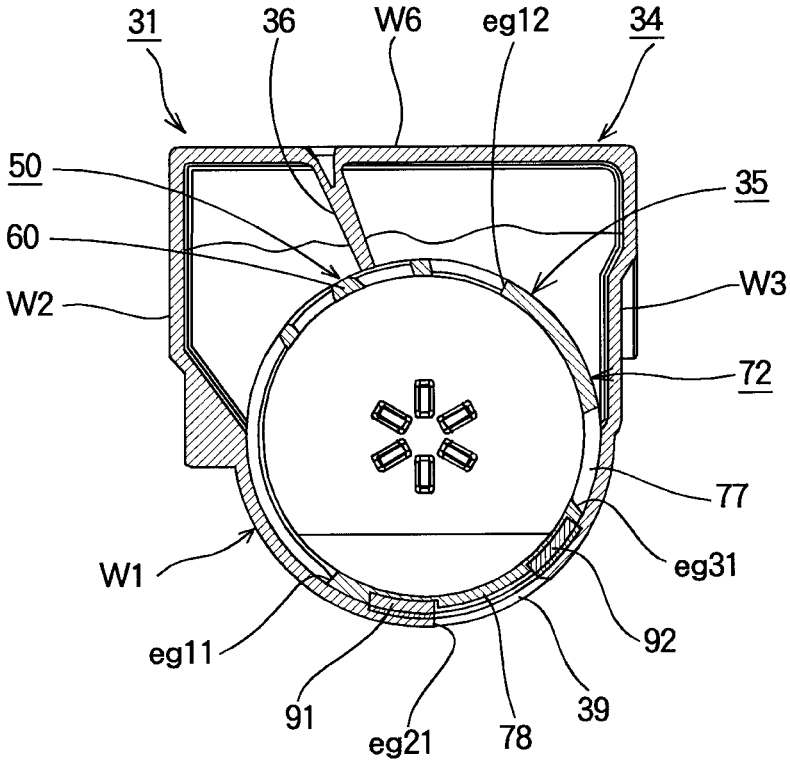
FIG. 4 is a cross-sectional view showing a toner cartridge according to the first embodiment of the present invention.
Figure 5:
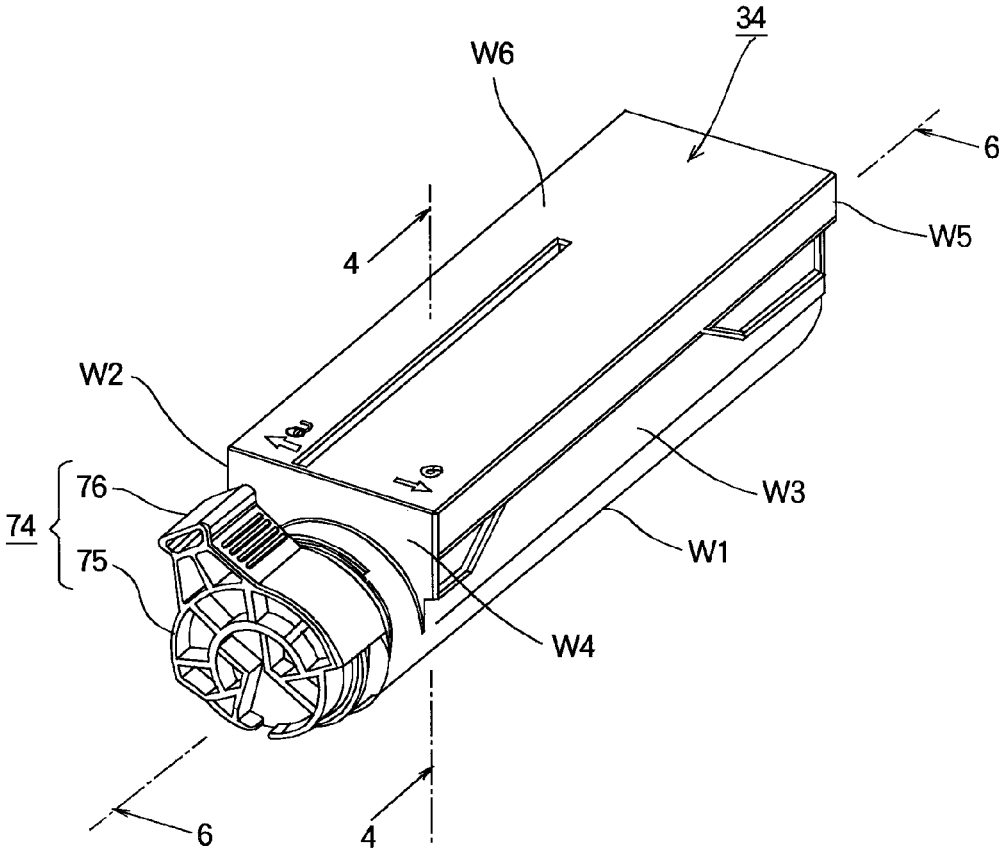
FIG. 5 is a perspective view showing an outer shape of the toner cartridge according to the first embodiment of the present invention.
Figure 6:
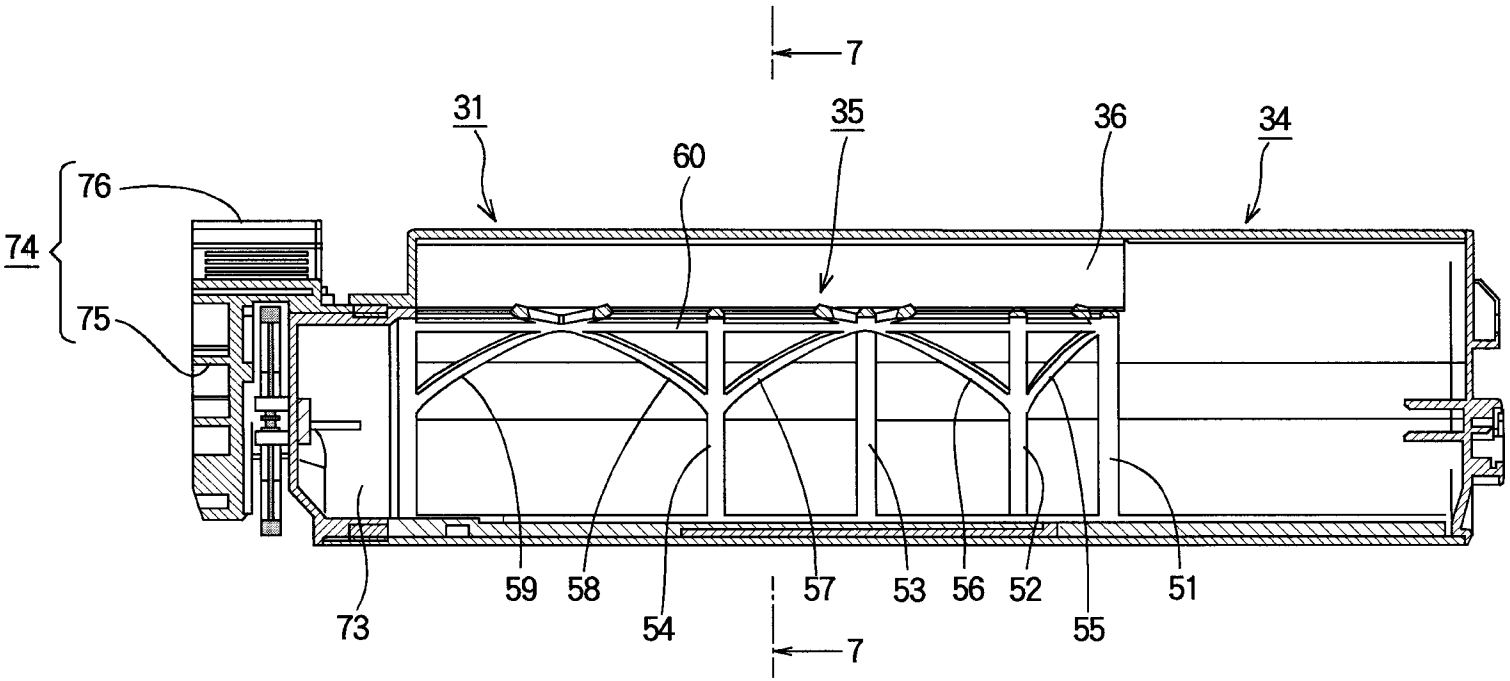
FIG. 6 is a longitudinal sectional view showing the toner cartridge according to the first embodiment of the present invention.
Figure 7:
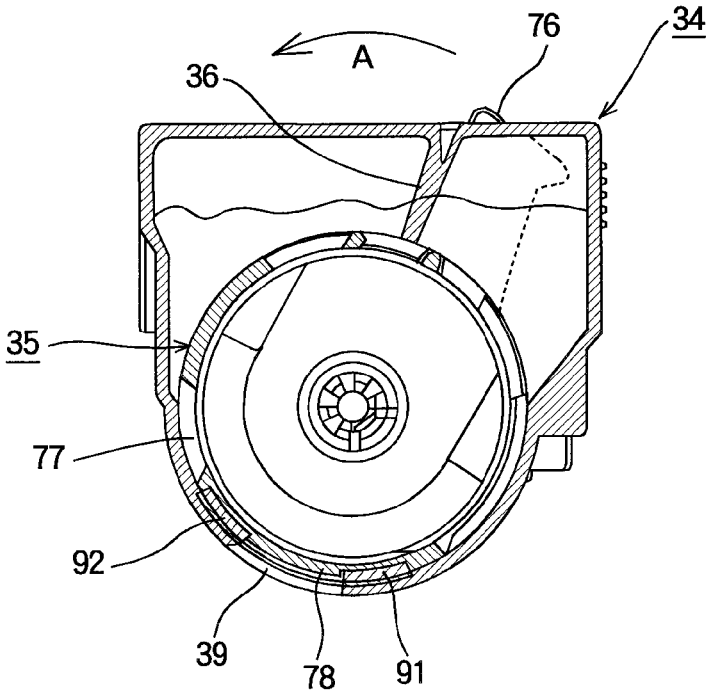
FIG. 7 is a cross-sectional view showing the toner cartridge according to the first embodiment of the present invention in a state where a toner supply opening is closed.
Figure 8:
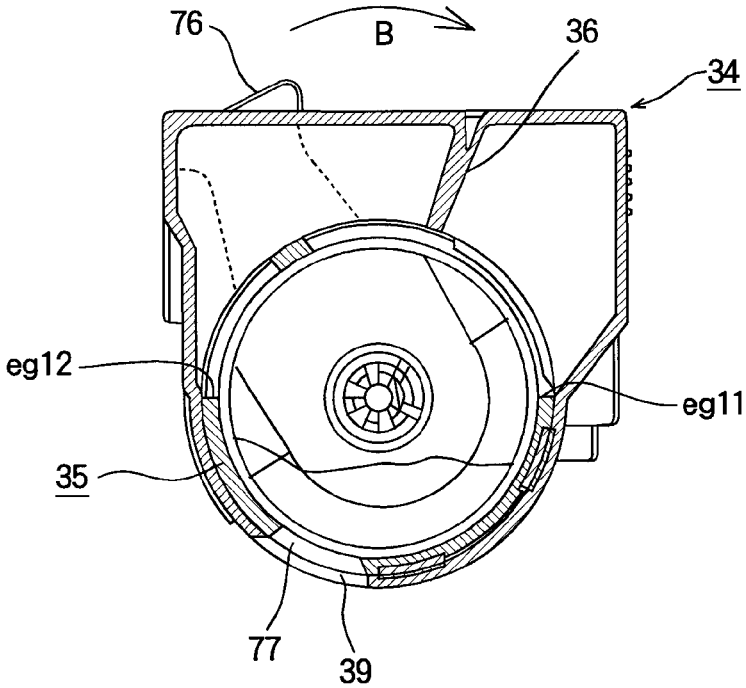
FIG. 8 is a cross-sectional view showing the toner cartridge according to the first embodiment of the present invention in a state where the toner supply opening is opened.
Figure 9A:
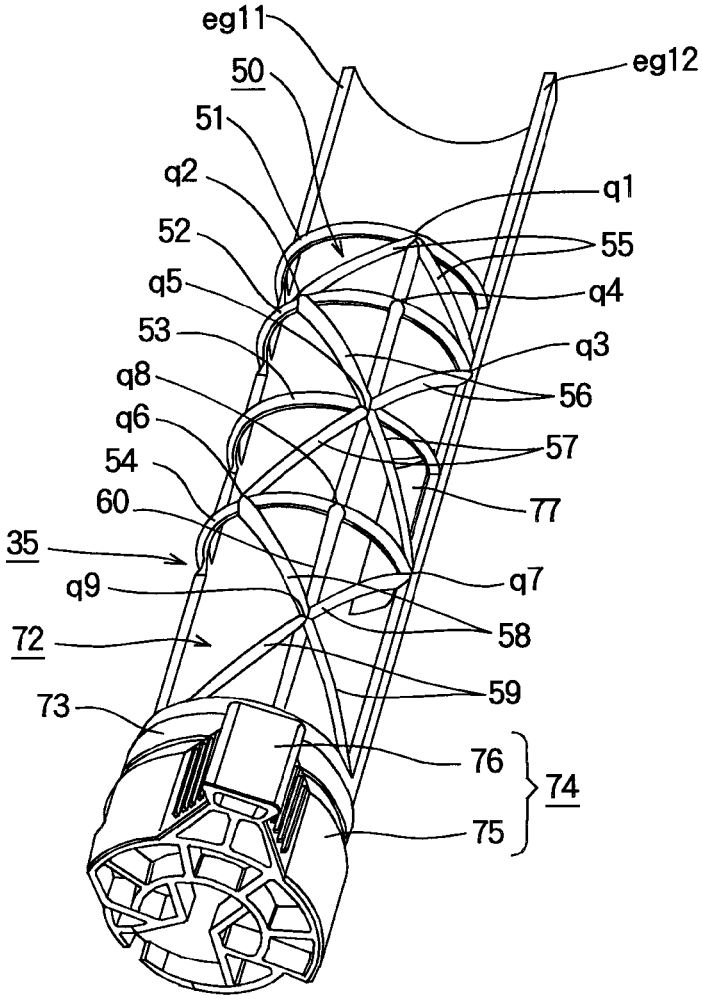
FIG. 9A is a perspective view showing an inner case of the toner cartridge according to the first embodiment of the present invention.
Figure 10A:
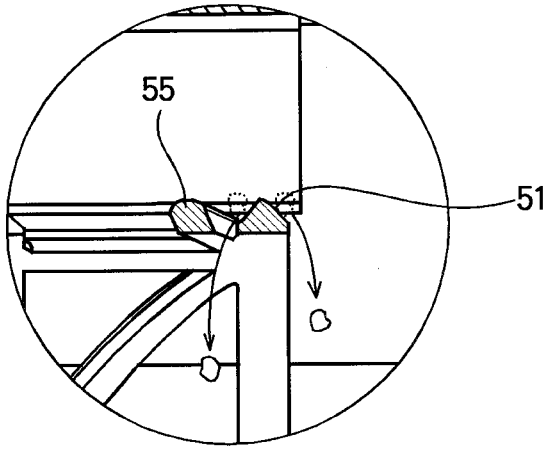
FIG. 10A is an enlarged view showing a part of the inner case of the toner cartridge according to the first embodiment of the present invention.
Figure 10B:
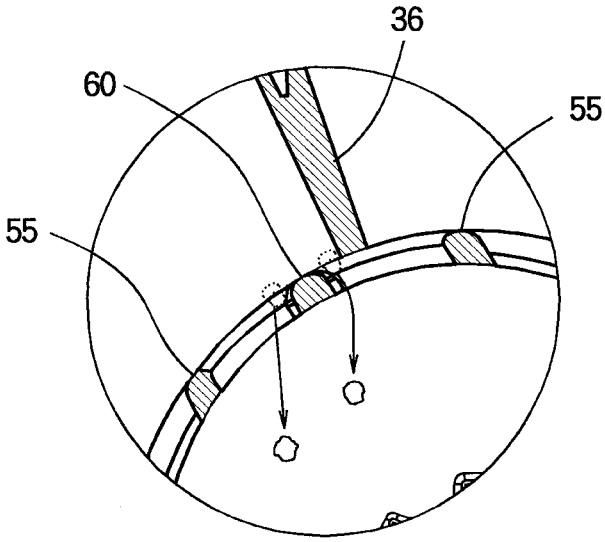
FIG. 10B is an enlarged view showing another part of the inner case of the toner cartridge according to the first embodiment of the present invention.

FIG. 4 is a cross-sectional view showing the toner cartridge 31 according to the first embodiment of the present invention. FIG. 5 is a perspective view showing an outer shape of the toner cartridge 31. In this regard, FIG. 4 corresponds to a cross-sectional view taken along line 4-4 in FIG. 5. FIG. 6 is a longitudinal sectional view showing the toner cartridge 31, taken along line 6-6 in FIG. 5. FIG. 7 is a cross-sectional view showing the toner cartridge 31 in a state where a toner supply opening 39 is closed, taken along line 7-7 in FIG. 6. FIG. 8 is a cross-sectional view showing the toner cartridge 31 in a state where the toner supply opening 39 is opened, taken along line 7-7 in FIG. 6. FIG. 9A is a perspective view showing an inner case 35 of the toner cartridge 31. FIG. 10A is an enlarged view showing a part of the inner case of the toner cartridge 31. FIG. 10B is an enlarged view showing another part of the inner case 35 of the toner cartridge 31.

As shown in FIG. 4, the toner cartridge 31 has an outer case 34 and an inner case 35 rotatably provided in the outer case 34. The outer case 34 has an elongated shape as shown in FIG. 5. The inner case 35 is slidably rotatable with respect to the outer case 34 about a rotation axis parallel to a longitudinal direction of the outer case 34. The toner cartridge 31 has a knob portion 74 as an operating portion for rotating the inner case 35 with respect to the outer case 34.

The outer case 34 has a bottom wall W1 having a semicircular cross-sectional shape. The outer case 34 further has side walls W2 and W3 extending upward from the bottom wall W1, and front and rear end walls W4 and W5 (FIG. 5) extending upward from the bottom wall W1. The outer case 34 further has a flat top wall W6, and a protrusion 36 protruding from the top wall W6 toward the inner case 35. The protrusion 36 is in the form of an elongated thin plate, and extends in the longitudinal direction of the outer case 34. The bottom wall W1, the side walls W2 and W3, the end walls W4 and W5 and the top wall W6 enclose a space for storing the toner, and form a toner storage chamber (as a developer storage chamber). The toner supply opening 39 as a first opening (i.e., an opening of the outer case 34) is formed on the bottom wall W1. The toner supply opening 39 is located at a predetermined position in a circumferential direction of the bottom wall W1. Further, the toner supply opening 39 is in the form of an elongated hole extending a predetermined length along the longitudinal direction of the outer case 34.

The protrusion 36 protrudes downward from an inner surface of the top wall W6 toward the rotation axis (i.e., a center axis) of the inner case 35. The protrusion 36 extends parallel to an axial direction of the inner case (i.e., longitudinal direction of the outer case 34), and reaches the same position as the inner case 35 in the axial direction. Further, the protrusion 36 is disposed in opposition to the toner supply opening 39 with respect to the center axis of the inner case 35. To be more specific, a center of the toner supply opening 39 in a widthwise direction and a tip of the protrusion 36 are apart from each other by 180 degrees with respect to the center axis of the inner case 35. Inner edges eg21 surrounding the toner supply opening 39 are inclined (tapered) so that an opening area of the toner supply opening 39 increases from an inner circumferential surface of the bottom wall W1 toward an outer circumferential surface of the bottom wall W1.

In this embodiment, the toner supply opening 39 is located at a position shifted from a lowermost position of the bottom wall W1 so as to correspond to a position to which the toner falls in the toner chamber 33 (FIG. 2). Therefore, the protrusion 36 is inclined toward the center of the toner supply opening 39 in the widthwise direction. In this regard, it is also possible to form the toner supply opening 39 at the lowermost position of the bottom wall W1. In this case, the protrusion 36 is formed to extend vertically from the inner surface of the top wall W6.

The inner case 35 includes an arcuate cylindrical portion 72 as a bottom wall having an arcuate cross-section. The arcuate cylindrical portion 72 extends in a circumferential direction at a predetermined angle, for example, substantially 180 degrees, and acts as a shutter. The inner case 35 further includes a truss construction 50 as a beam construction provided so as to bridge between two edges eg11 and eg 12 of the arcuate cylindrical portion 72 in a circumferential direction. The inner case 35 further includes a cylindrical part 73 provided at an end of the arcuate cylindrical portion 72 and the truss construction 50 in the axial (longitudinal) direction.

The knob portion 74 (the operating portion) includes a knob supporting portion 75 of a cylindrical shape formed integrally with and adjacent to the cylindrical part 73 of the inner case 35. The knob portion 74 further includes a knob 76 protruding outward (in a radial direction) from the knob supporting portion 75 at a predetermined position in the circumferential direction of the knob supporting portion 75.

The inner case 35 has a supply opening 77 as a second opening (i.e., an opening of the inner case 35) formed on the arcuate cylindrical portion 72. The supply opening 77 is located at a predetermined position in the circumferential direction of the arcuate cylindrical portion 72. Further, the supply opening 77 is in the form of an elongated hole, and extends a predetermined length in the axial direction of the arcuate cylindrical portion so as to correspond to the toner supply opening 39. The inner case 35 further has a closing portion 78 formed on the arcuate cylindrical portion 72 and adjacent to the supply opening 77 in the circumferential direction. Inner edges eg31 surrounding the supply opening 77 are inclined so that an opening area of the supply opening 77 increases from an inner circumferential surface of the arcuate cylindrical portion 72 toward an outer circumferential surface of the arcuate cylindrical portion 72. Seal members 91 and 92 are bonded to predetermined positions on an outer circumferential surface of the closing portion 78. The seal members 91 and 92 are formed of sheet-like bodies.

When an operator holds the knob 76 and rotates the inner case 35 in directions shown by arrows A and B (FIGS. 7 and 8) with respect to the outer case 34, the inner case rotates between a closing position where the closing portion 78 is overlapped with the toner supply opening 39 (i.e., the toner supply opening 39 is closed) as shown in FIG. 7, and an opening position where the supply opening 77 is overlapped with the toner supply opening 39 (i.e., the toner supply opening 39 is opened) as shown in FIG. 8.

In a state where the inner case 35 is in the closing position, the tip of the protrusion 36 is in a position opposite to the closing portion 78, and presses the inner case 35 toward the toner supply opening 39. Therefore, in the state where the inner case 35 is in the closing position, the seal members 91 and 92 are located on both sides of the toner supply opening 39 in the circumferential direction, and are pressed against the inner circumferential surface of the outer case 34. With such a configuration, leakage of the toner through between the outer case 34 and the inner case 35 is prevented.

Next, the truss construction 50 will be described.

In FIG. 9A, the truss construction 50 includes a plurality of beams 51, 52, 53 and 54 as first beams (bar-shaped members) extending in the circumferential direction so as to bridge between the edges eg11 and eg12 of the inner case 35. The beams 51, 52, 53 and 54 are located at a plurality of (in this example, four) positions in the axial direction of the inner case 35 distanced from each other. The truss construction 50 further includes beams 55, 56, 57, 58 and 59 as second beams extending so as to be inclined with respect to the beams 51 through 54. The truss construction 50 further includes a beam 60 as a third beam extending in the axial direction of the inner case 35 and intersecting respective centers of the beams 51 through 54.

The beam 51 and the beam 52 are connected by the two beams 55 and the beam 60. The beam 52 and the beam 53 are connected by the two beams 56 and the beam 60. The beam 53 and the beam 54 are connected by the two beams 57 and the beam 60. The beam 54 and the cylindrical part 73 are connected by the two beams 58, the two beams 59 and the beam 60.

To be more specific, the two beams 55 extend between the beam 51 and the adjacent beam 52 so that the two beams 55 intersect each other. The two beams 56 extend between the beam 52 and the adjacent beam 53 so that the two beams 56 intersect each other. The two beams 57 extend between the beam 53 and the adjacent beam 54 so that the two beams 57 intersect each other. The two beams 58 and the two beams 59 extend between the beam 54 and the adjacent cylindrical part 73 so that the two beams 58 and the two beams 59 intersect each other. With such a configuration, the truss construction 50 has a high strength.

As described above, when the inner case 35 is in the closing position, the protrusion 36 of the outer case 34 (in the position opposite to the closing portion 78) presses the inner case 35 toward the toner supply opening 39. In this state, since the beams 51 through 54 extend perpendicular to an extending direction of the protrusion 36 (i.e., the longitudinal direction of the outer case 34), the beams 55 through 59 extend so as to be inclined with respect to the extending direction of the protrusion 36, and the beam 60 extends parallel to the extending direction of the protrusion 36, the truss construction 50 is not twisted, deformed or broken. Since the strength of the truss construction 50 is ensured, the inner case 35 can press the seal members 91 and 92 against the inner surface of the outer case 34 with a sufficient force. Thus, even when the toner cartridge 31 is dropped onto the ground in a state where the toner supply opening 39 is closed, or even when the toner cartridge 31 is applied with vibration, it is ensured that the toner is prevented from leaking outside through between the outer case 34 and the inner case 35.

In this regard, the beams 51 through 60 are formed to have sufficient widths so that the truss construction 50 is not deformed or broken.

Further, the truss construction 50 has portions at each of which two beams intersect each other. For example, the beams 51, 55 and 60 intersect each other at a portion q1. The beams 52, 55 and 56 intersect each other at portions q2 and q3. The beam 52 and the beam 60 intersect each other at a portion q4. The beams 53, 56, 57 and 60 intersect each other at a portion q5. The beams 54, 57 and 58 intersect each other at portions q6 and q7. The beam 54 and the beam 60 intersect each other at a portion q8. The beams 58, 59 and 60 intersect each other at a portion q9. The portions q1 through q9 have relatively large areas.

In this regard, if the toner is accumulated on the beams 51 through 60 and the portions q1 through q9, such accumulated toner is not supplied to the image forming unit main body 19.

Figure 9B:
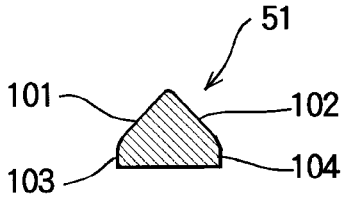
FIGS. 9B and 9C are schematic cross-sectional views showing cross-sectional shapes of beams of the inner case shown in FIG. 9A.

Therefore, in the first embodiment, each of the beams 51 through 54 has a substantially triangular cross-sectional shape pointing upward (i.e., outward in a radial direction of the inner case 35). As a representative example, FIG. 9B shows a cross-sectional shape of the beam 51. As shown in FIG. 9B, the beam 51 has inclined upper surfaces (i.e., upper ends) 101 and 102 which are inclined downward in a gravity direction (i.e., a vertical direction) toward respective side ends 103 and 104.

Figure 9C:
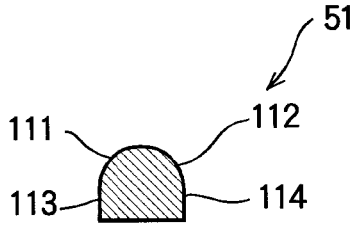

Further, each of the beams 55 through 60 has a substantially semicircular cross-sectional shape which is convex upward. As a representative example, FIG. 9C shows a cross-sectional shape of the beam 60. As shown in FIG. 9C, the beam 60 has inclined upper surfaces 111 and 112 which are inclined downward in the gravity direction toward respective side ends 113 and 114.

As schematically shown in FIGS. 10A and 10B, the toner is not likely to be accumulated on the inclined upper surfaces of the beams 51 through 60 and respective portions q1 through q9. Therefore, the toner cartridge 31 can supply a sufficient amount of toner to the image forming unit main body 19.

The advantages of the first embodiment will be described in comparison with Comparison Example.

Figure 11:
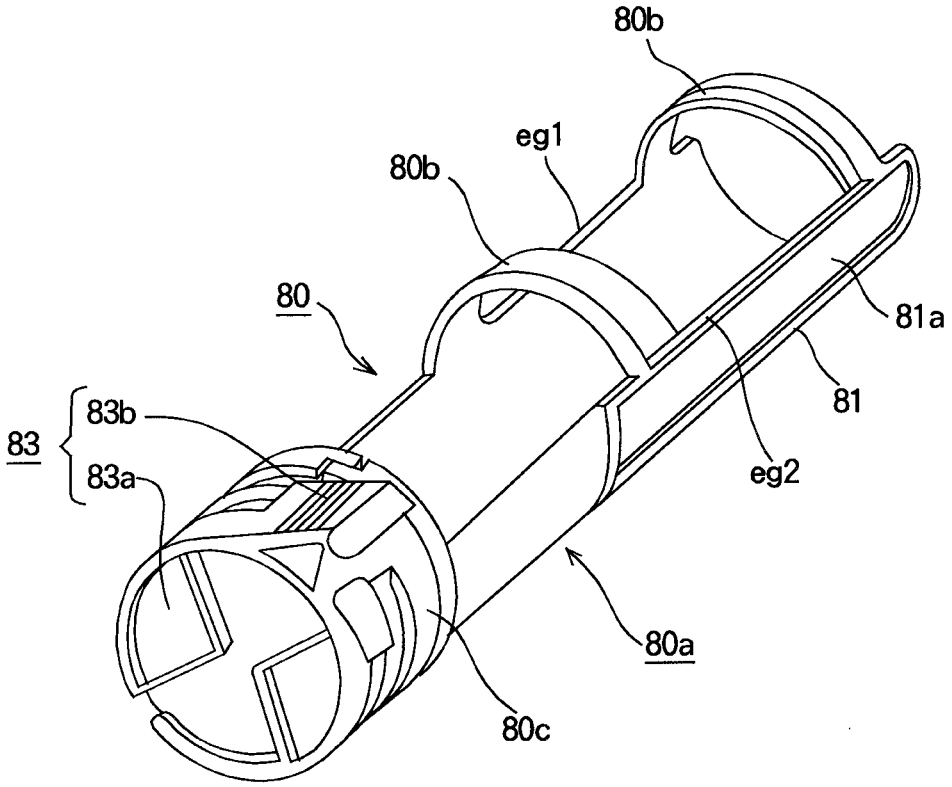
FIG. 11 is a perspective view showing an inner case of a toner cartridge of a comparison example.

FIG. 11 is a perspective view showing an inner case of a toner cartridge of Comparison Example. A knob portion 83 is provided for rotating the inner case 80 with respect to a not shown outer case. The inner case 80 includes an arcuate cylindrical portion 80*a* having an arcuate cross-sectional shape, and two band-shaped portions 80*b* extending in a circumferential direction between two edges eg1 and eg2 of the arcuate cylindrical portion 80*a*. A cylindrical part 80*c* is provided on an end portion of the arcuate cylindrical portion 80*a* in an axial direction. A supply opening 81*a* is formed on the arcuate cylindrical portion 80*a* for supplying the toner to the image forming unit main body. The knob portion 80*a* includes a knob supporting portion 83*a* and a knob 83*b*.

In Comparison Example, the toner may be accumulated on flat upper surfaces of the band-shaped portions 80*b*. Such a toner remains within the toner cartridge, and is not supplied to the image forming unit main body.

In contrast, according to the first embodiment, as shown in FIGS. 9A through 9C and FIGS. 10A and 10B, the beams 51 through 60 have inclined upper surfaces which are inclined downward in the gravity direction toward respective side ends in the cross-section. Therefore, the toner is prevented from being accumulated on the beams 51 through 60, and a sufficient amount of toner can be supplied from the toner cartridge 31 to the image forming unit main body 19.

Various modifications can be made to the first embodiment.

Figure 12A:
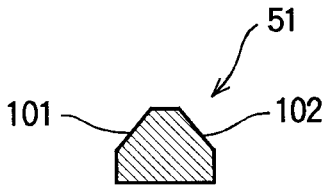
FIGS. 12A and 12B are schematic cross-sectional views showing other examples of the cross-sectional shapes of the beams of the inner case shown in FIG. 9A.
Figure 12B:
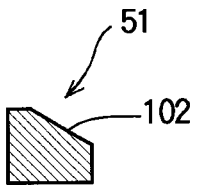

For example, the cross-sectional shapes of the beams 51 through 60 are not limited to those shown in FIGS. 9B and 9C. It is only necessary that each of the beams 51 through 60 has at least one inclined upper surface which is inclined downward in the gravity direction toward a side end in the cross-section. For example, the beam 51 (and/or any other beam of the truss construction 50) can have a substantially trapezoidal cross-sectional shape as shown in FIG. 12A, and can have a cross-sectional shape with only one inclined upper end (inclined upper surface) as shown in FIG. 12B.

Figure 13A:
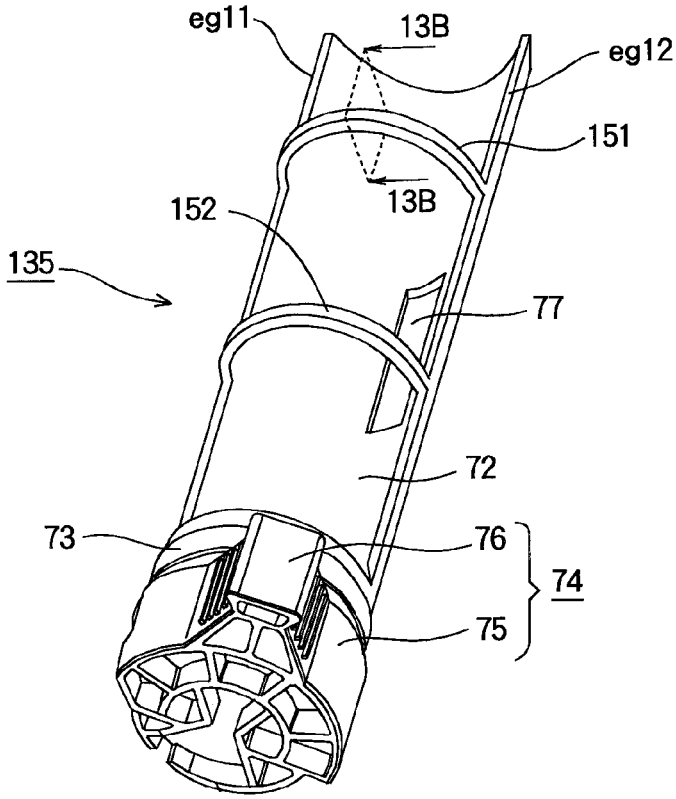
FIG. 13A is a perspective view showing an inner case of the toner cartridge according to the second embodiment of the present invention.

Further, FIG. 13A is a perspective view showing an inner case 135 of a modification of the first embodiment of the present invention.

Figure 13B:
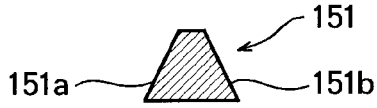
FIGS. 13B through 13E are schematic cross-sectional views showing other examples of the cross-sectional shapes of the beams of the inner case shown in FIG. 13A.

The inner case 135 shown in FIG. 13A has at least one (in this example, two) beam 151 extending in a circumferential direction so as to bridge the edges eg11 and eg12 of the arcuate cylindrical portion 72. FIG. 13B is a cross-sectional view of the beam 151 taken along a plane indicated by arrows 13B in FIG. 13A. The beam 151 has a trapezoidal cross-sectional shape which is convex upward (i.e., outward in a radial direction). The beam 151 has two inclined upper surfaces (i.e., upper ends) which are inclined downward in the gravity direction toward respective side ends.

With such a configuration, the toner is prevented from being accumulated on the beams 15, and a sufficient amount of toner can be supplied from the toner cartridge to the image forming unit main body.

Figure 13C:
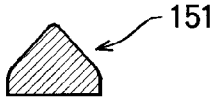
Figure 13D:
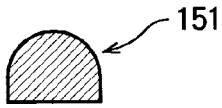
Figure 13E:
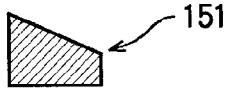

The cross-sectional shape of the beam 151 is not limited to the trapezoidal shape. For example, the beam 151 can have a substantially triangular cross-sectional shape as shown in FIG. 13C. Further, the beam 151 can have a substantially semicircular cross-sectional shape as shown in FIG. 13D. It is also possible that the beam 151 has only one inclined upper surface as shown in FIG. 13E.

Second Embodiment

In the above described first embodiment, the toner may be accumulated on the edges eg11 and eg12 of the arcuate cylindrical portion 72 since the edges eg11 and eg12 become parallel to a horizontal plane when the inner case 35 is in the opening position as shown in FIG. 8. The second embodiment is intended to prevent such accumulation of the toner on the edges eg11 and eg12 of the arcuate cylindrical portion 72.

Components of the second embodiment that are the same as those of the first embodiment are assigned the same reference numerals. With regard to the advantages obtained by the components which are the same as those of the first embodiment, explanations of the first embodiment are herein incorporated.

Figure 14:
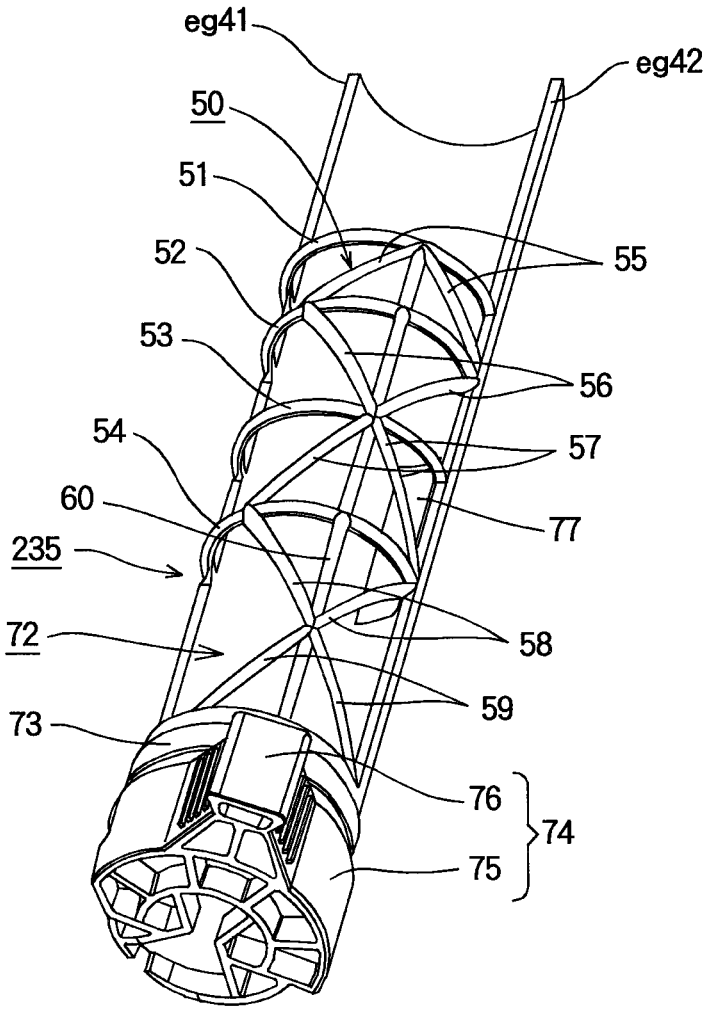
FIG. 14 is a perspective view showing the inner case of the toner cartridge according to the second embodiment of the present invention.
Figure 15:
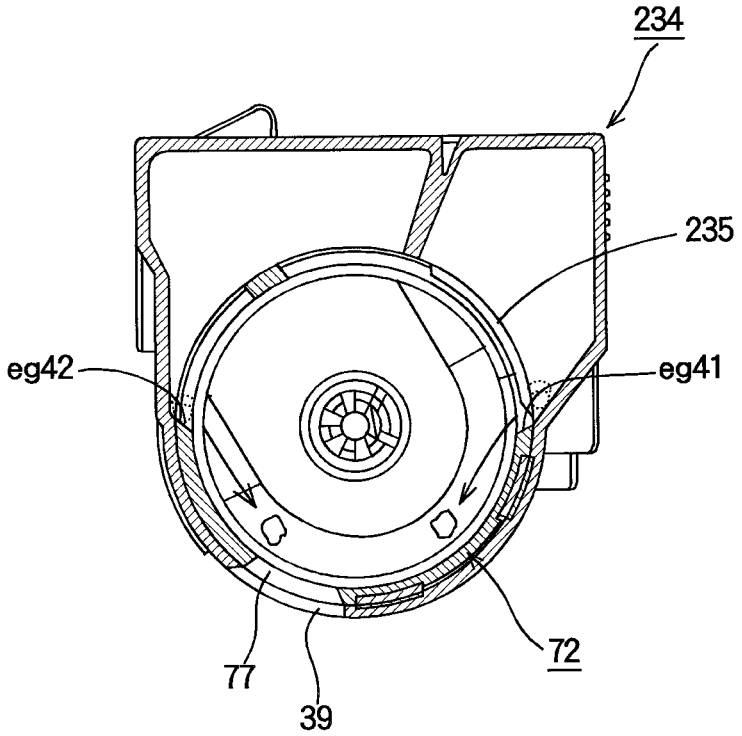
FIG. 15 is a cross-sectional view showing the inner case of the toner cartridge according to the second embodiment of the present invention.

FIGS. 14 and 15 are a perspective view and a cross-sectional view showing an inner case 235 of the second embodiment. The inner case 235 of the second embodiment is different from the inner case 35 of the first embodiment (FIG. 9A) in the shape of edges eg41 and eg42 of the arcuate cylindrical portion 72.

In the second embodiment, the edges eg41 and eg42 are inclined with respect to a gravity direction (i.e., vertical direction) at a predetermined angle, for example, 45 degrees or more, in a state where the inner case 235 is in the opening position as shown in FIG. 15. Each of the edges eg41 and eg42 is inclined in such a manner that a height increases from an inner end (i.e., an end closer to the center of the inner case 235) toward an outer end (i.e., an end facing the outer case 234) in the radial direction of the inner case 235.

Therefore, the toner is prevented from being accumulated on the edges eg41 and eg42 of the arcuate cylindrical portion 72. Thus, a sufficient amount of toner can be supplied from the toner cartridge 31 to the image forming unit main body 19.

In this regard, the modification of the first embodiment (FIGS. 12A through 13E) can also be applied to the second embodiment.

In the above embodiments, descriptions have been made to the printer 10 as an example of the image forming apparatus. However, the present invention is applicable to a facsimile machine, a copier, a multifunction peripheral or the like. Further, although descriptions have been made to the monochrome printer, the present invention is applicable to a color image forming apparatus.

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:

an outer case enclosing a space in which a developer is stored, said outer case having a first opening;

an inner case rotatably provided in said outer case and having a second opening, said inner case being rotatable with respect to said outer case between an opening position in which said inner case opens said first opening, and a closing position in which said inner case closes said first opening, and an operating portion provided for operation to rotate said inner case with respect to said outer case between said opening position and said closing position, wherein said inner case includes a bottom wall having said second opening, and a plurality of beams extending between edges of said bottom wall, and wherein at least one beam of said plurality of beams has a first connecting portion and a second connecting portion which are connected to said bottom wall or at least one of the other beams of said plurality of beams, and extends between said first connecting portion and said second connecting portion, wherein said at least one beam has an inclined upper surface constituting an upper part of a periphery of a cross-section cut by a plane perpendicular to an extending direction of said at least one beam between said first connecting portion and said second connecting portion, and wherein said inclined upper surface constituting said upper part of said periphery is inclined in a gravity direction toward a side end of said at least one beam on said periphery.

2. The developer storage body according to claim 1, wherein said plurality of beams are combined with each other to form a beam construction.

3. The developer storage body according to claim 2, wherein said plurality of beams include a first beam extending along a circumferential direction of said inner case, a second beam extending so as to be inclined with respect to said first beam, and a third beam extending along a rotation axis of said inner case.

4. The developer storage body according to claim 1, wherein said beam has a substantially triangular, semicircular or trapezoidal cross-sectional shape.

5. The developer storage body according to claim 1, wherein when said inner case is in said opening position where said first opening and said second opening overlap each other, said edges of said bottom wall are inclined with respect to a horizontal direction.

6. The developer storage body according to claim 1, wherein said outer case has a protrusion that protrudes from an inner circumferential surface of said outer case, and said protrusion presses said inner case against a bottom wall of said outer case.

7. The developer storage body according to claim 6, wherein said protrusion is formed in opposition to said first opening.

8. The developer storage body according to claim 1, wherein said operating portion is formed integrally with and adjacent to an end of said inner case.

9. An image forming unit to which said developer storage body according to claim 1 is mounted.

10. An image forming apparatus to which said image forming unit according to claim 9 is mounted.

11. The image forming unit according to claim 9, wherein said gravity direction is a gravity direction in a state where said developer storage body is mounted to said image forming unit.

12. The developer storage body according to claim 1, wherein said gravity direction is a gravity direction in a state where said second opening is at a lower position.

13. A developer storage body comprising:

an outer case enclosing a space in which a developer is stored, said outer case having a first opening;

an inner case rotatably provided in said outer case and having a second opening, said inner case being rotatable with respect to said outer case between an opening position in which said inner case opens said first opening, and a closing position in which said inner case closes said first opening, and an operating portion provided for operation to rotate said inner case with respect to said outer case between said opening position and said closing position, wherein said inner case includes a bottom wall having said second opening, and a plurality of beams extending between edges of said bottom wall, said plurality of beams being combined with each other to form a beam construction, wherein said plurality of beams include a first beam extending along a circumferential direction of said inner case, a second beam extending so as to be inclined with respect to said first beam, and a third beam extending along a rotation axis of said inner case, wherein said first beam has an inclined upper surface, and wherein said inclined upper surface is inclined downward in a gravity direction toward a side end of said first beam in a cross-section of said first beam.

* * * * *